US006497060B1

(12) United States Patent
Bolan, Jr. et al.

(10) Patent No.: US 6,497,060 B1
(45) Date of Patent: Dec. 24, 2002

(54) APPARATUS AND METHOD FOR PRESSING SHIRT COLLAR AND CUFFS

(75) Inventors: Thomas V. Bolan, Jr., Andover, NJ (US); John Dehler, New Albany, PA (US); Perrin R. Vaning, Dushore, PA (US); Paul A. Karpich, Springville, PA (US)

(73) Assignee: Hoffman/New Yorker, Inc., Bloomfield, NJ (US)

( * ) Notice: Subject to any disclaimer, the term of this patent is extended or adjusted under 35 U.S.C. 154(b) by 0 days.

(21) Appl. No.: 09/949,554

(22) Filed: Sep. 10, 2001

(51) Int. Cl.[7] ..... D06F 71/24; D06F 71/32
(52) U.S. Cl. ..... 38/21
(58) Field of Search ..... 38/4, 5, 14, 15, 38/21, 22, 7, 24, 66, 69, 20; 223/52, 52.1, 52.5, 72–74

(56) References Cited

U.S. PATENT DOCUMENTS

| | | | | |
|---|---|---|---|---|
| 1,883,604 A | | 10/1932 | Davis | |
| 2,464,857 A | | 3/1949 | Forse | |
| 3,136,079 A | * | 6/1964 | Neckel | 38/21 |
| 3,835,559 A | * | 9/1974 | Kotter | 38/21 |
| 4,057,179 A | * | 11/1977 | Everett | 223/73 |
| 4,634,030 A | | 1/1987 | Uchikoshi | |
| 4,843,745 A | | 7/1989 | Oberley | |
| 5,636,773 A | | 6/1997 | Harrod et al. | |
| 5,675,918 A | | 10/1997 | Harrod et al. | |
| 5,711,097 A | * | 1/1998 | Mino | 223/73 |
| 5,758,437 A | * | 6/1998 | Tamamoto | 223/52.1 |

OTHER PUBLICATIONS

Brochure "MODEL STHG", The Unipress Company.

Brochure, "Unique System Design Eliminates Profit–Eating Problems", CSS Series (La Serie CSS), Hoffman NewYorker, Inc. 1996.

* cited by examiner

*Primary Examiner*—Ismael Izaguirre
(74) *Attorney, Agent, or Firm*—Davis A. Tamburro

(57) ABSTRACT

A machine for pressing a shirt cuff and the pleated portion of a shirt sleeve adjacent the shirt cuff during the same pressing operation,. The machine includes a main upper head and a main lower buck which are closed to press the cuff. An auxiliary buck is mounted adjacent to and forwardly of the main buck to receive the pleated portion of the shirt. An auxiliary head is movable, after the main head and buck are closed, from a retracted non-pressing position to an extended position, pressing the pleated portion against the auxiliary buck.

6 Claims, 3 Drawing Sheets

APPARATUS AND METHOD FOR PRESSING SHIRT COLLAR AND CUFFS

BACKGROUND OF THE INVENTION

This invention relates generally to apparatus and method for pressing the collar and cuffs of a long sleeve shirt and more particularly to a machine capable of pressing the cuffs of a sleeve and the pleated area of the sleeve just above the cuff during the same pressing operation.

The sleeve of a standard long sleeve shirt is manufactured with a pleat just above the cuff on the outside edge of the shirt while wearing it. This pleat is present due to the fact that the sleeve diameter is larger than the cuff diameter causing the gathering of the material, hence the pleat. Traditionally, the collar and cuffs of the shirt are pressed in a single operation by a machine including a lower buck assembly constituting an essentially arched collar buck and an arched cuff buck at each end of the collar buck and an upper head assembly having collar and cuff pressing surfaces configured to mate with the lower buck surfaces to press a collar and cuffs of a shirt resting thereon. Typical of such machines is the ALC8 machine manufactured and sold by Hoffman/New Yorker, Inc., the assignee of this invention.

In traditional machines such as the ALC8 machine the collar and two cuffs of a shirt are pressed at the same time. The shirt is loaded on the machine, first by placing the collar on the central buck with the inside of the shirt facing up. Next the cuffs of the shirt are placed on the cuff bucks with the outside of the cuff facing up. The upper pressing head is then closed to press the shirt to the desired look. The pleat formed on the sleeve just above the cuff on the outside edge of the shirt is not pressed during this initial operation. When the shirt is removed from the press, the pleat is pressed by a secondary operation separate from the machine and is normally performed on an ironing board with a hand iron.

It certainly is desirable to be able to press the pleats on the sleeve during the same collar/cuff pressing operation, and thereby eliminate the separate manual pleat pressing operation. One proposal for accomplishing this is illustrated in U.S. Pat. No. 5,675,918. The upper and lower cuff pressing chests illustrated in that patent are of special configuration and include integral forward protruding portions for pressing the pleats simultaneously with pressing the cuffs themselves. The upper and lower chests also include a cut out portion for providing clearance for the unpleated portion of the sleeve. While the configuration illustrated in the '918 patent provides some benefits, it also suffers some disadvantages. For example, the special configuration of the upper and lower chests in deviating from the standard design used in the past, adds to the cost of the machine. Furthermore, during the pressing operation the cuff of the shirt has to be manually held on the lower cuff buck or chest while the pleated portion of the shirt is aligned on the protruding section of the chest and while the unpleated portion of the shirt is gathered at the cutout portion of the chest. This is necessary because as the upper chest is closed upon the lower chest, the cuff and pleats of the shirt are simultaneously pressed and there is no opportunity to realign the pleats if necessary. Thus, the step of placing the cuff and pleats on the lower chest can be awkward and can result in improper alignment in pressing the pleats.

Accordingly, the need for an efficient, reliable, economical machine for pressing the cuffs and pleated portion of a shirt sleeve during the same pressing operation remains, and the invention as described hereinafter has been developed to satisfy that need and to serve as an improvement over systems such as that illustrated in the '918 patent.

SUMMARY OF THE INVENTION

Accordingly, a primary object of this invention is to provide a novel shirt collar/cuff pressing machine which includes means for pressing the pleat on the shirt sleeve just above the cuff during the same collar/cuff pressing operation.

Another object of the invention is to provide the above novel machine wherein the main collar and cuff pressing heads and pressing bucks are essentially the same as those used in prior standard machines such as the ALC8 machine and wherein separate pleat pressing heads and bucks are provided to press the pleats of the sleeves during the same pressing operation.

Another object of the invention is to provide the above novel machine wherein the pleat pressing heads are operated independently of the main pressing heads of the machine.

The above objectives are accomplished by providing each cuff pressing head and buck with a separate auxiliary pleat pressing head and buck, respectively, which are independently actuatable to press the pleat area of a shirt sleeve located just above the cuff of the sleeve. The pleat pressing buck is mounted adjacent to and extends forwardly from each main cuff pressing buck and a pleat pressing head is connected to and extends forwardly from each main cuff pressing head so as to be positioned above and below the pleat pressing area of the shirt sleeve when the main head is closed upon the cuff positioned upon the main buck. Each pleat pressing head is extended through a pressing stroke by a pneumatic non-rotating air cylinder which the press operator energizes separately from the main pressing heads.

Operation of the novel machine of this invention is as follows. A shirt is loaded on the machine first by placing the collar of the shirt on the collar pressing buck with the inside of the shirt facing up. Next, each cuff of the shirt is placed on its respective cuff pressing buck with the outside of the cuff facing up. In this position the pleats on the shirt sleeves will be positioned inwardly of the cuff bucks adjacent the main collar buck. With the collar and cuffs properly loaded on the collar and cuff bucks, the operator hits start buttons to close the main head down upon the main buck to lock the collar and cuffs of the shirt in place for pressing between the main heads and the main bucks. At this time the separate pleat pressing heads remain spaced from the pleats of the shirt so that the shirt can be dressed, that is, arranged to properly align the pleats, simply by pulling on the shirt sleeves. The cuffs themselves are being held in place by the main head and main buck and will not pull away from the machine. Thus, the operator has both hands available to quickly and properly align the pleats. When the desired dressed look of the pleats is obtained the operator energizes a foot operated air pedal to close the auxiliary pleat pressing heads towards the pleat pressing bucks and thus press the pleat area of the shirt sleeves positioned between the pleat heads and pleat bucks. Steam is then supplied to the main and auxiliary heads and bucks and the novel machine will then press the shirt to the desired look and when completed the pleat heads will retract and the main head will open.

It is apparent that applicant's novel method of operation eliminates the need to press the pleats by way of a secondary operation such as by using an iron and traditional ironing board. Furthermore, the provision of the separate pleat pressing heads and bucks which are not operated until the cuffs themselves are being held by the main head and bucks enables the operator to more quickly and more reliably dress the shirt, that is, align the pleats prior to the pleat pressing operation. In addition, if the operator does not want to press the pleats, the pleat pressing heads and bucks may be deactivated and the machine can be used in a conventional manner.

Other objects and advantages of the invention will become apparent from reading the following detailed description of the invention wherein reference is made to the accompanying drawings.

DETAILED DESCRIPTION OF THE INVENTION

Figure 1:
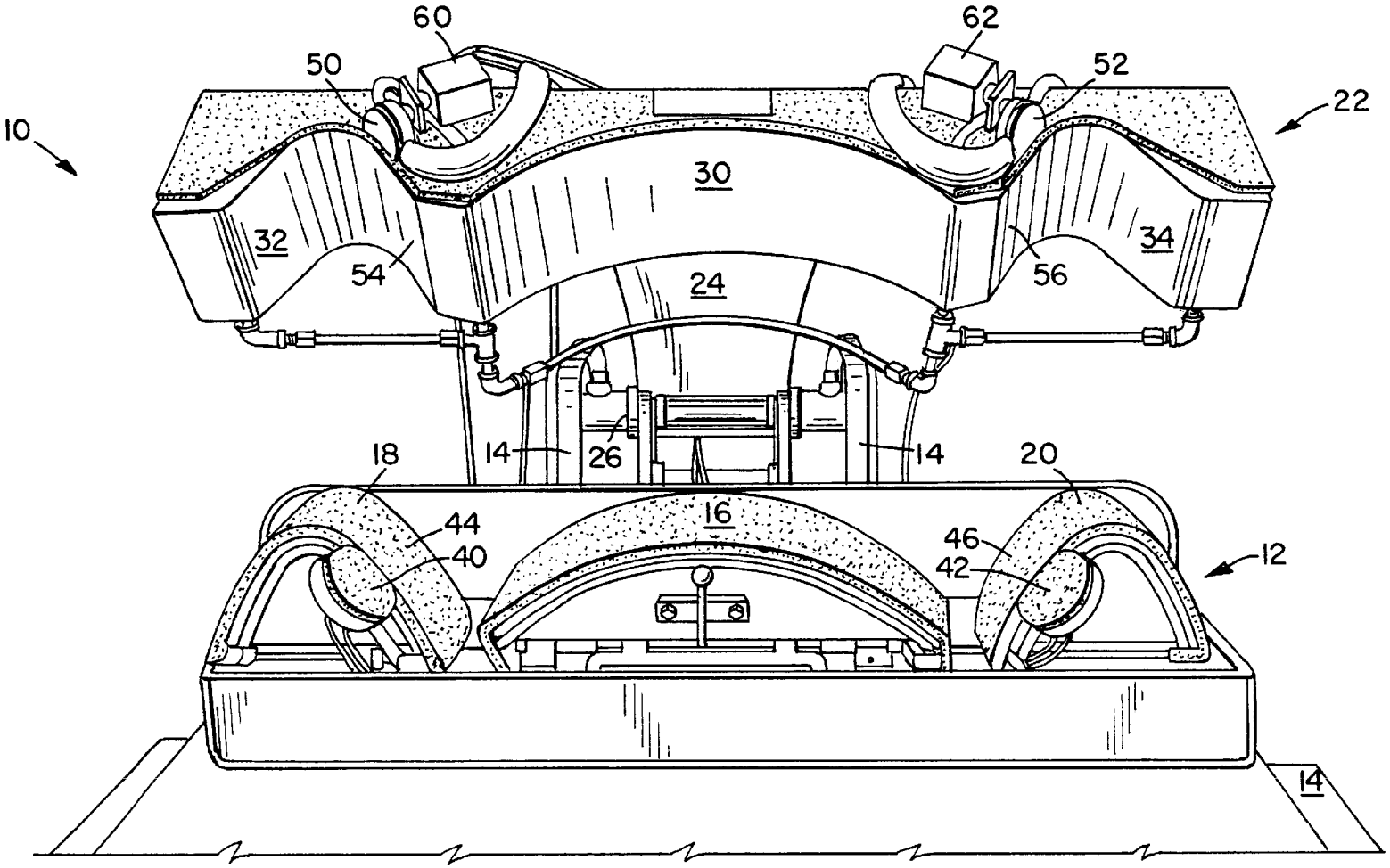
FIG. 1 is a perspective front view of the buck and head assemblies of the novel pressing machine of the invention with the head assembly in an open position.

Referring now to the drawings, the novel collar cuff pressing machine 10 of the invention includes a lower buck assembly 12 mounted on a horizontal table 14 of the frame of the machine. Buck assembly 12 includes a center elongated arched collar pressing buck member 16 and cuff pressing arched buck members 18 and 20 at opposite ends of the collar pressing buck 16. Bucks 16, 18 and 20 are provided with suitable padding just as in conventional machines.

A pressing head assembly 22 is supported on an arm 24 which is pivotally mounted at 26 to frame 14 for movement between an open position shown in FIG. 1 and a closed pressing position in which it engages against the collar and cuffs of a shirt laying on bucks 16, 18 and 20. Pressing head assembly 22 includes contoured pressing surfaces 30, 32 and 34 which conform to the shape of bucks 16, 18 and 20, respectively so as to perform the pressing operation as described. Buck assembly 12 and head assembly 22 are steam heated in the usual fashion and the machine as described to this point is essentially the same as the assignee's prior commercial ALC8 machine and thus no further detailed description of those elements is necessary.

Buck assembly 12 also includes smaller auxiliary pleat pressing bucks 40 and 42 which are rigidly mounted on a support frame and extend forwardly from and are in alignment with the inner pressing surfaces 44 and 46 of bucks 18 and 20, respectively. Bucks 40 and 42 are padded in the same manner as bucks 18 and 20.

Pressing head assembly 22 includes a pair of pneumatically operated auxiliary pleat pressing heads 50 and 52 mounted on the front face of head assembly 22 and extending forwardly from and in general alignment with the inner portions 54 and 56 of pressing surfaces 32 and 34, respectively, so as to be in operative pleat pressing relationship with auxiliary bucks 40 and 42, respectively, when head assembly 22 is closed on buck assembly 12. Heads 50 and 52 are reciprocated from a normally retracted non-pressing position to an extended pressing position by non-rotating double-acting air cylinders 60 and 62 independently of the operating system for the main head assembly 22. The auxiliary pleat pressing bucks 40 and 42 and heads 50 and 52 are steam heated in the same manner as the main bucks 16, 18 and 20 and main head pressing surfaces 30, 32 and 34.

Figure 2:
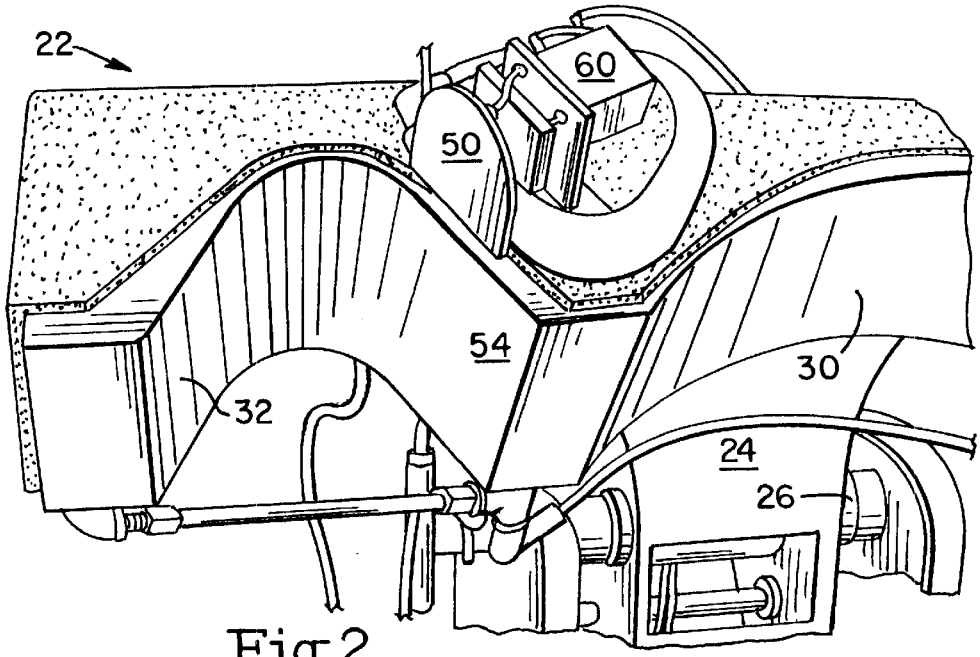
FIG. 2 is an enlarged fragmentary perspective view illustrating the pleat pressing head mounted on and forwardly of a main cuff pressing head with the head in an open position as in FIG. 1.
Figure 3:
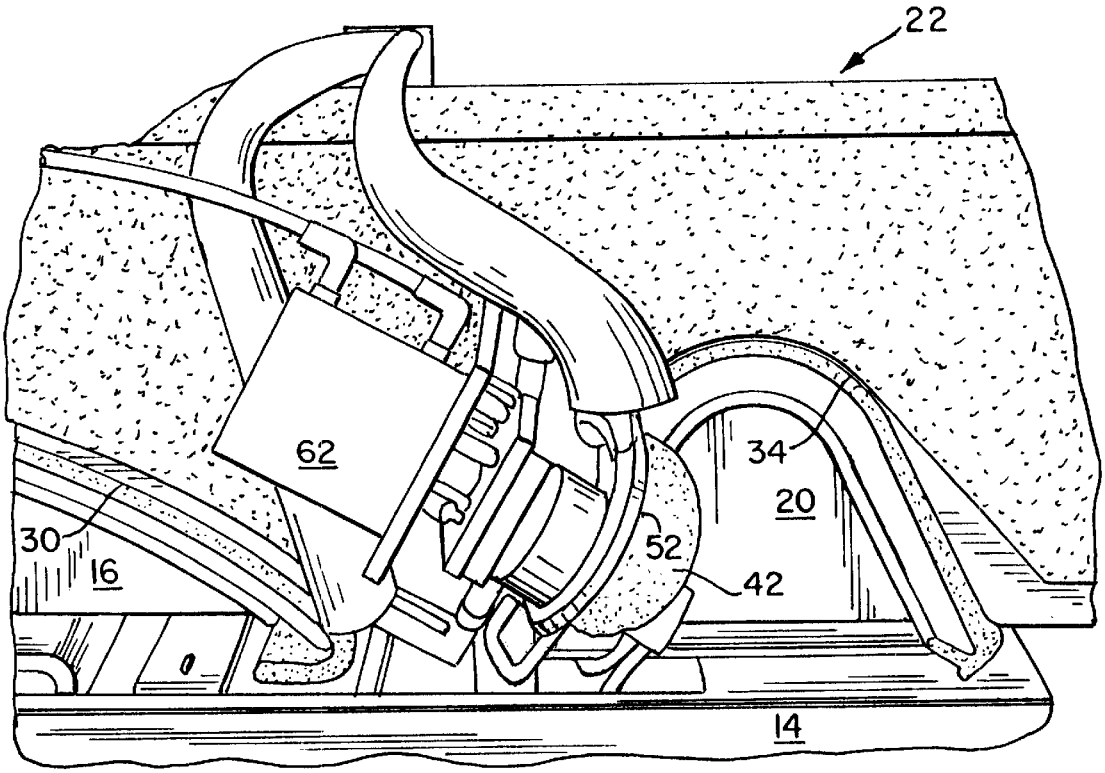
FIG. 3 is a fragmentary enlarged front perspective view illustrating the main pressing head and an auxiliary pleat pressing head in closed positions so as to press the cuff and pleat of a sleeve of a shirt positioned between the heads and the bucks.
Figure 4:
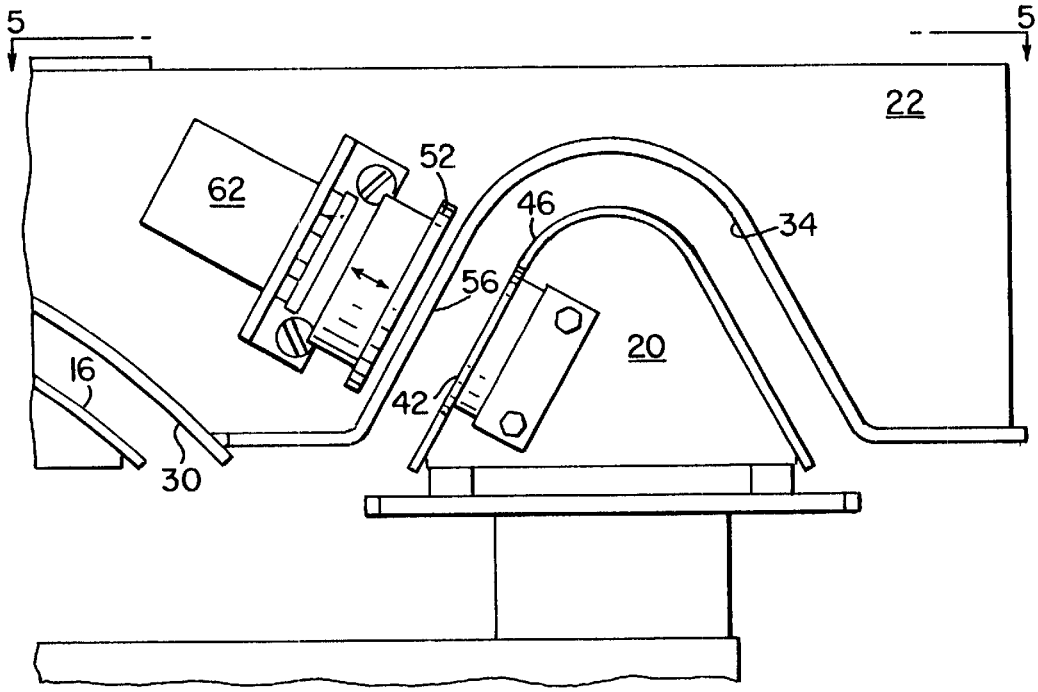
FIG. 4 is a fragmentary front elevation schematic of a cuff pressing head and buck assembly incorporating the auxiliary pleat pressing head and buck assembly, with the padding which is normally provided on the cuff buck and the pleat buck being removed.
Figure 5:
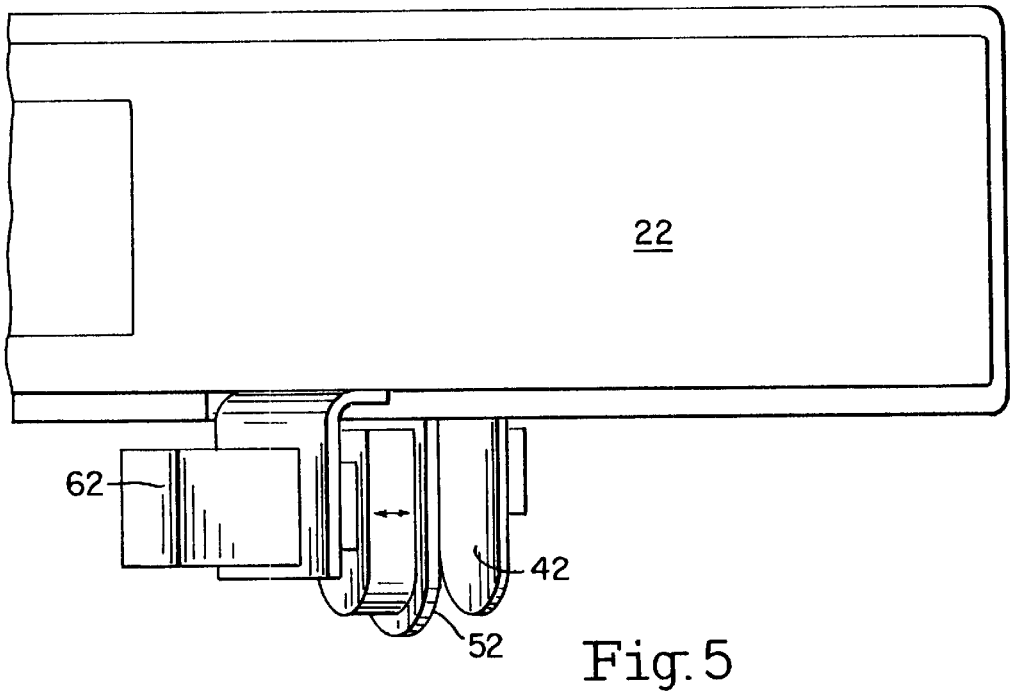
FIG. 5 is a plan view taken generally along line 5—5 of FIG. 4 illustrating the manner in which the auxiliary pleat pressing head and buck extends forwardly from the main cuff pressing head and buck so as to be able to press the pleat portion of the shirt sleeve located just above the cuff.

The novel pressing machine 10 of the invention operates as follows. With the pressing head assembly 22 in the open position as shown in FIG. 1, a long sleeve shirt is loaded on the machine, first by placing the collar of the shirt on buck 16 with the inside of the shirt facing up. Next the cuff of the right sleeve of the shirt is placed on buck 18 with the outside of the cuff facing up. The cuff of the left sleeve of the shirt is similarly placed on buck 20 with the outside of the cuff facing up with the cuffs positioned so that the pleats on the shirt sleeves just above the cuffs will be lying on auxiliary bucks 40 and 42. The operator then presses the main start buttons of the machine to move head assembly 22 down towards buck assembly 12 so that the pressing head surfaces 30, 32 and 34 press the collar and cuffs against bucks 16, 18 and 20, respectively. The head 22 is then locked into this pressing position. The auxiliary heads 50 and 52 will be facing the pleated portions of the shirt sleeves supported on bucks 40 and 42, but the heads are still held in a retracted position by air cylinders 60 and 62 as illustrated in FIGS. 1, 2 and 4, spaced approximately ¼ inch or so from the pleated portion. Thus, an operator has the opportunity to dress the sleeves, that, is align the pleats as desired simply by pulling on the shirt sleeves. Since the cuffs themselves are already being held in place by closure of the main heads on the main bucks, the sleeves will not pull away from the machine and the operator has both hands available for dressing those sleeves. When the operator is satisfied with the dressed look of the sleeve on buck 40, a common foot-operated air pedal is actuated to energize air cylinders 60 and 62 to extend the pleat pressing heads 50 and 52 into pressing engagement with the pleats on bucks 40 and 42. Steam is then supplied to main bucks 16, 18 and 20, main head surfaces 30, 32 and 34, auxiliary bucks 40, 42, and auxiliary heads 50, 52. When the pressing operation is completed, air cylinders 60 and 62 are actuated in a reverse direction to retract auxiliary heads 50 and 52 and the main head assembly 22 is opened. The shirt is then removed form the machine with the collar, cuffs and pleated area of the sleeves having been pressed in the same pressing operation. This saves substantial time in that the hand ironing operation of the pleats, normally required by conventional machines, has been eliminated. In addition, if the operator does not want to press the pleats, the pneumatic system for operating the air cylinders 60 and 62 can be disabled and the machine and be used in the more traditional fashion.

From the description hereinabove, it is apparent that the invention accomplishes the objectives noted initially and provides advantages over prior conventional machines such as the ALC8 machine and over systems such as that illustrated in U.S. Pat. No. 5,675,918. First of all the main head and buck assemblies of the machine are essentially the same as those used in prior conventional machines such as the ALC8 machine and require little modification therefrom. The provision of the separate pleat pressing head and buck assemblies and their separate operations, enable the operator to properly dress the shirt sleeves, that is, align the pleats, while the cuffs themselves are being held in place between the main heads and bucks. The operator may use one or both hands to dress the shirt sleeves by pulling on the sleeves without being concerned about pulling the cuffs away from the machine. Further, if for some reason the operator does not want to press the pleats, the auxiliary pleat pressing heads need not be activated and the machine can be used in its conventional fashion.

If desired, machine 10 may be modified in several respects. For example, air cylinders 60 and 62 may be of the single acting type and spring loaded to hold heads 50 and 52 in a normally retracted position. Also, each of the cylinders 60 and 62 may be actuated by its own separate foot pedal.

The invention may be embodied in other specific forms without departing from the spirit or essential characteristics thereof The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. Apparatus for pressing a shirt cuff and a pleated portion of a sleeve adjacent the shirt cuff comprising a lower buck and an upper pressing head, said buck and said head having cooperating arch-shaped pressing surfaces for pressing a cuff dressed on said buck upon mating closure of said buck and said head, an auxiliary buck mounted adjacent and extending forwardly of said lower buck to permit the pleated portion of the sleeve to be dressed thereon, an auxiliary pressing head mounted adjacent and extending forwardly of said upper head so as to lie in operative relationship with said auxiliary buck and the pleated portion dressed thereon upon closure of said lower buck and said upper head, actuating means holding said auxiliary pressing head in a retracted non-pressing position until said lower buck and said upper head are closed and thereafter moving said auxiliary pressing head toward said auxiliary buck to press the pleated portion dressed thereon.

2. The apparatus of claim 1, said actuating means including an air operated cylinder.

3. Apparatus for pressing the collar and cuffs of a shirt and pleated portions of the sleeves adjacent the shirt cuffs comprising a lower buck assembly having a central collar pressing buck and a cuff pressing buck at each end of said collar buck, an upper pressing head assembly having a central collar pressing surface and a cuff pressing surface at each end of said collar pressing surface and adapted to press the collar and cuffs of a shirt dressed on said lower buck assembly upon closure of said lower buck assembly and said upper head assembly, an auxiliary buck mounted adjacent and extending forwardly of each of said cuff pressing bucks to permit the pleated portion of a sleeve to be dressed thereon, an auxiliary pressing head mounted adjacent and extending forwardly of each of said cuff pressing surfaces of said pressing head assembly so as to lie in operating relationship with said auxiliary buck and the pleated portion dressed thereon upon closure of said lower buck assembly and said upper pressing head assembly, actuating means holding each said auxiliary pressing head in a retracted nonpressing position until said lower buck assembly and said upper pressing head assembly are closed and thereafter moving said auxiliary pressing head toward said auxiliary buck to press the pleated portion dressed thereon.

4. The apparatus of claim 3, said actuating means including an air operated cylinder.

5. A method of pressing a shirt cuff and a pleated portion of a sleeve adjacent the shirt cuff comprising:

providing a shirt pressing machine having a lower buck and an upper pressing head, said buck and said head having cooperating arch shaped pressing surfaces for pressing a cuff dressed on said buck upon mating closure of said buck and said head, an auxiliary buck mounted adjacent and extending forwardly of said lower buck to permit the pleated portion of the sleeve to be placed thereon, an auxiliary pressing head mounted adjacent and extending forwardly of said upper head so as to lie in operative relationship with said auxiliary buck upon closure of said lower buck and upper head;

placing said shirt cuff on said lower buck and said pleated portion on said auxiliary buck;

closing said upper head and said lower buck so that said pressing surfaces are mated in engagement with said cuff;

maintaining said auxiliary head in a retracted non-pressing position while said upper head and said lower buck are being closed;

aligning said pleated portion on said auxiliary buck while said cuff is being held between said upper ahead and said lower buck;

extending said auxiliary head into pressing engagement with said pleated portion against said auxiliary buck;

pressing said shirt cuff and said pleated portion;

releasing said auxiliary head to its retracted position and opening said upper head and lower buck so that the shirt cuff and said pleated portion may be removed from the machine.

6. A method of pressing the collar and cuffs of a shirt and the pleated portions of the sleeves adjacent the shirt cuffs comprising:

providing a pressing machine including a lower buck assembly having a central collar pressing buck and a cuff pressing buck at each end of said collar buck, an upper pressing head assembly having a central collar pressing surface and a cuff pressing surface at each end of said collar pressing surface and adapted to press the collar and cuffs of a shirt placed on said lower buck assembly upon closure of said lower buck assembly and said upper head assembly, an auxiliary buck mounted adjacent and extending forwardly of each of said cuff pressing bucks to permit the pleated portion of a sleeve to be placed thereon, an auxiliary pressing head mounted adjacent and extending forwardly of each of said cuff pressing surfaces of said pressing head assembly so as to lie in operating relationship with said auxiliary buck and the pleated portion placed thereon upon closure of said lower buck assembly and said upper pressing head assembly;

placing said shirt collar on said collar pressing buck, said cuffs on said cuff pressing bucks, and said pleated portions on said auxiliary bucks;

closing said upper head assembly and said lower buck assembly to press said collar and said cuffs therebetween;

maintaining said auxiliary heads in a retracted non-pressing position while said upper head assembly and said lower buck assembly are being closed;

aligning said pleated portions of said sleeves on said auxiliary bucks while said cuffs are being held between said upper head assembly and said lower buck assembly;

extending said auxiliary heads into pressing engagement with said pleated portions against said auxiliary bucks;

pressing said collar, said cuffs, and said pleated portions;

releasing said auxiliary heads to their retracted positions and opening said upper head assembly and said lower buck assembly so that the collar, cuffs and pleated portions may be removed from the machine.

* * * * *